United States Patent [19]

Ando et al.

[11] 4,054,409

[45] Oct. 18, 1977

[54] SWIRLING BURNERS FOR USE IN HOT BLAST STOVES

[75] Inventors: Ryo Ando; Kazuo Sano; Takao Miyazaki, all of Yokohama, Japan

[73] Assignee: Nippon Kokan Kabushiki Kaisha, Tokyo, Japan

[21] Appl. No.: 685,686

[22] Filed: May 12, 1976

[30] Foreign Application Priority Data

May 15, 1975 Japan ..... 50-56714

[51] Int. Cl.[2] ..... F23C 5/18

[52] U.S. Cl. ..... 431/173; 266/139; 431/177; 431/190; 432/99; 432/217

[58] Field of Search ..... 431/353, 9, 8, 173, 431/174, 177, 190, 352; 266/139; 432/99, 96, 217, 193

[56] References Cited

U.S. PATENT DOCUMENTS

| | | | |
|---|---|---|---|
| 749,502 | 1/1904 | Teichgraeber | 432/214 |
| 2,153,951 | 4/1939 | Barber | 432/184 |
| 2,707,444 | 5/1955 | Loon | 431/173 |
| 2,808,011 | 10/1957 | Miller et al. | 431/9 |
| 3,105,540 | 10/1963 | Hardgrove | 431/9 |
| 3,165,399 | 1/1965 | Kennedy | 266/139 |
| 3,473,793 | 10/1969 | Cronert | 266/139 |
| 3,746,498 | 7/1973 | Stengel | 431/10 |

FOREIGN PATENT DOCUMENTS

| | | | |
|---|---|---|---|
| 85,989 | 3/1919 | France | 432/96 |

OTHER PUBLICATIONS

American Iron and Steel Institute [Steel Making Flow Charts], published 1970.

*Primary Examiner*—John J. Camby
*Assistant Examiner*—Robert J. Charvat
*Attorney, Agent, or Firm*—Flynn & Frishauf

[57] ABSTRACT

The swirling burner comprises a vertical combustion chamber and an annular blast member located beneath the combustion chamber and provided with a central cylindrical space and a plurality of alternately superposed fuel gas passages and air passages. These passages are communicated with the cylindrical space through blow openings which are inclined in the same direction with respect to the radii of the cylindrical space. In a modification, the burner is further combined with straight blowing type burner for promoting the effect of the air-gas mixing.

8 Claims, 11 Drawing Figures

Fig-1
PRIOR ART
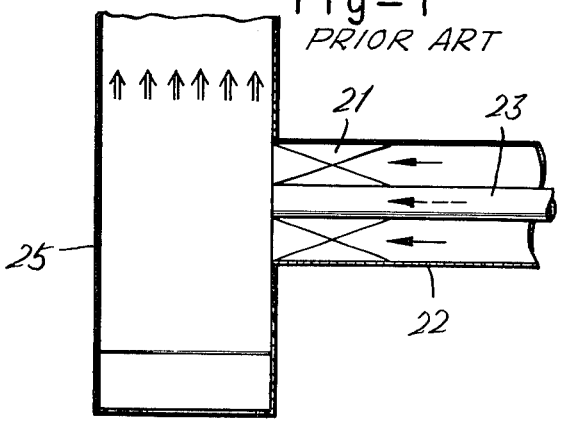
Fig-2
PRIOR ART
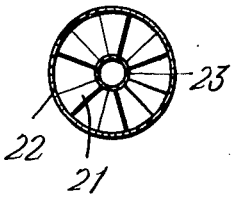
PRIOR ART Fig-3
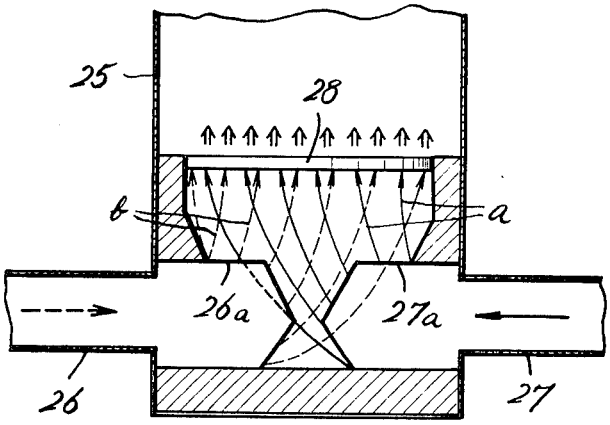
Fig-4
PRIOR ART
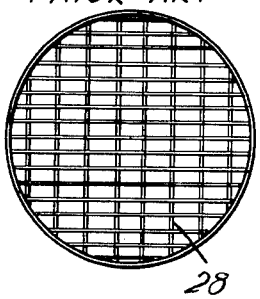

SWIRLING BURNERS FOR USE IN HOT BLAST STOVES

BACKGROUND OF THE INVENTION

This invention relates to a swirling burner for use in a stove in connection with a blast furnace the stove being, for example, connected with the blast furnace.

In a blast furnace, for the purpose of storing heat it is usual to burn fuel in the combustion chamber by using a burner and to store the heat of combustion in a heat accumulating chamber connected to the combustion chamber. Among prior burners utilized with such blast furnaces are included a type wherein air and fuel gas are blown into the combustion chamber through rotary blades, thereby rotating the air and fuel gas mixture for burning it rapidly; and a type wherein a ceramic grill is disposed above blow heads for blowing air and fuel gas and provided at the bottom of the combustion chamber, thus ejecting the air-fuel mixture straight upwardly and causing it to burn. These prior art burners have advantages and defects as follows. More particularly, the recent tendency of increasing the capacity of the blast furnace and development in the art of high temperature air supply requires combustion under a high load. With the burner using rotary blades, an oscillatory combustion occurs when the flow quantity is increased so that this type of burner is not suitable for high load combustion using a large quantity of fuel gas. Although the burner using a grill is free from such defects since the air and fuel gas as ejected upwardly from the burner as parallel streams, they are not sufficiently mixed together with the result that the flame extends too long or after burning occurs due to entrance of the not burned fuel gas into the heat accumulating chamber. This causes local abnormal heating of the heat accumulating chamber and damage and disintegration of gitter bricks. Consequently, the pressure loss increases abnormally which causes decrease in the quantity of gas combustion. Moreover, the length of the flame is greatly influenced by the change in the percentage of excess air. These phenomena make it difficult to maintain a stable combustion state.

SUMMARY OF THE INVENTION

It is an object of this invention to provide an improved swirling burner for use in a hot blast stove with a blast furnace capable of eliminating various defects described above.

Another object of this invention is to provide an improved swirling burner capable of forming a stable flame of a limited length by forming a counter flow region in the combustion chamber, thereby assuring complete combustion.

According to this invention, these and further objects can be accomplished by providing a swirling burner for use in a hot blast stove comprising a vertical combustion chamber, and an annular blast member located beneath the combustion chamber substantially in coaxial relationship therewith, the annular blast member being provided with a central cylindrical space, a plurality of alternately superposed fuel gas passages and air passages about the cylindrical space and a plurality of fuel gas openings and air blow openings for communicating the fuel gas and the air passages with the cylindrical space, said fuel gas openings and air blow openings being inclined in the same direction with respect to the radii from the axis of the cylindrical space.

The fuel gas openings and the air blow openings may be horizontal or inclined with respect to the vertical.

In a modified embodiment, the burner further comprises a fuel gas blow head and an opposed air blow head which are located below the annular blast member and a grill made of ceramic or other heat resistant material located between the annular blast member and the blow heads for creating a straight upward flow of the air-gas mixture.

The swirling burner of this invention can form a upward swirling stream of the air-gas mixture in the central cylindrical space and the combustion chamber, thereby assuring intimate admixture of the air and fuel gas. This enhances complete combustion of the fuel gas and stabilizes the flame. Moreover the length of the flame is limited, thus preventing excessive elongation of the flame and accompanying difficulty of after burning. Moreover, the combustion region is enlarged and the gas and air are adequately mixed together, thus preventing turbulence and oscillatory combustion. For this reason, the swirling burner of this invention is especially suitable for use in a modern large capacity blast furnace wherein a large quantity of gas is burned under a high load condition. Moreover, according to the swirling burner of this invention, a counter flow region is formed in the central portion of the combustion chamber which functions as a flame holder so that the flame is formed more stably with a shorter length without being affected by the variation in the flow quantity and ratio of air and fuel gas. Such counter flow also increases the stay time of the fuel gas in the combustion, thus contributing to more complete combustion.

BRIEF DESCRIPTION OF THE DRAWINGS

Further objects and advantages of the invention can be more fully understood from the following detailed description taken with the accompanying drawings in which:

FIG. 1 is a diagrammatic vertical sectional view showing a prior art burner for producing a swirling flow;

FIG. 2 is a cross-sectional view of the burner shown in FIG. 1;

FIG. 3 is a vertical sectional view showing another prior art burner utilizing a ceramic grill for producing parallel upward flows;

FIG. 4 is a plan view of the ceramic grill utilized in the burner shown in FIG. 3;

DESCRIPTION OF THE PREFERRED EMBODIMENTS

Figure 5:
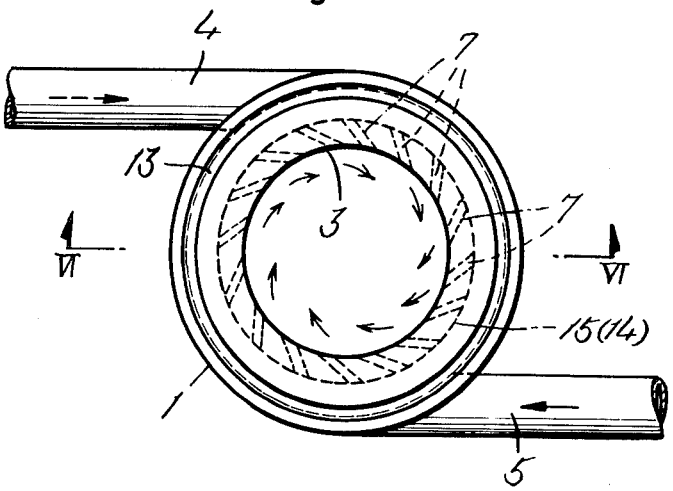
FIG. 5 is a plan view of one embodiment of the burner of this invention.

FIGS. 1 and 2 show prior art burners utilizing blades for creating a swirling flow and adapted to be used for blast furnaces. Fuel gas supplied through a gas pipe 23 and air supplied through an air pipe 22 surrounding the gas pipe are mixed together by twisted blades 21 positioned at the inlet to a combustion chamber 25. The swirling motion of the air-gas mixture assures rapid and complete combustion of the fuel gas. This type of the burner is mainly used for relatively small blast furnaces in which the burners are contained in the combustion chambers.

In another type of prior art burner shown in FIGS. 3 and 4, instead of concentrically disposing the fuel gas pipe and the air pipe as shown in FIGS. 1 and 2, air pipe 27 and gas pipe 26 are connected to the bottom of the combustion chamber 25 at diametrically opposite points and the inner ends of the air and gas pipes terminate with blow heads 27*a* and 26*a,* respectively. As shown by solid line arrows *a* and dotted line arrows *b* the air and gas, respectively, are ejected as a plurality of streams which are mixed together near the exit of a ceramic grill 28 having a thickness of approximately 200 mm, and thereafter the mixture is caused to flow straight toward the exit of the burner to burn. This type of burner is mainly used for a so-called separate type blast furnace of a relatively large capacity wherein the combustion chamber and the heat accumulating chamber are installed separately. In recent years, however, as the capacity of the blast furnace has increased and the technique of supplying hot air has made a great advance, such a large capacity blast furnace requires combustion under a high load condition. Conventional burners having various defects pointed out hereinabove can not meet such requirement.

More particularly, in the burner shown in FIGS. 1 and 2, as the flow quantity increases oscillatory combustion is formed so that it can not be applied for a modern blast furnace which burns a large amount of gas under a heavy load condition. More particularly, air and gas pipes 22 and 23 and combustion chamber 25 form an air column oscillation mode system. Further, the air and gas pipes 22 and 23 occupy a large space of the burner so that a flow quantity variation is intimately related to pressure variation. Moreover, as the swirling air and gas are admitted into the combustion chamber perpendicularly to the wall thereof when the quantity of the air and gas is increased a strong turbulent flow is formed. Consequently, even though admixing of air and gas might be improved locally, considering the entire region of combustion, the high temperature combustion region would be decreased, thus decreasing the degree of swirling motion due to turbulation which is caused by the increase in the flow quantity. This causes the mixture to become unstable, resulting in a piston like or oscillatory combustion which is intensified with the load.

With the construction shown in FIGS. 3 and 4, the combustion region is enlarged and as the gas and air are admitted independently there is no fear of the oscillatory combustion. On the other hand, since the air and gas are respectively divided into fine upward streams they are not admixed sufficiently. This causes too long a flame as well as entrance of the not yet burned gas into the heat accumulating chamber causing after burning. As a result, local abnormal heating of the heat accumulating chamber and damage of the gitter bricks are caused. This also causes a decrease in the quantity of combustion due to an abnormal increase in the pressure drop. Furthermore, the flame length is greatly influenced by the variation in the percentage of the surplus air. These defects make it difficult to establish and maintain stable combustion.

Figure 6:
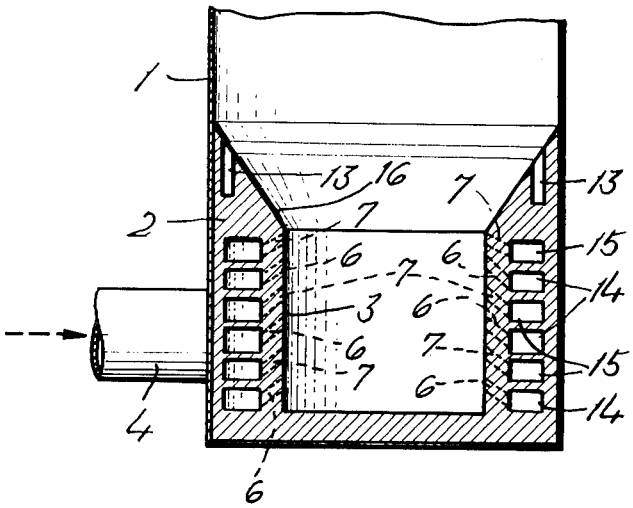
FIG. 6 is a vertical sectional view of the burner shown in FIG. 5 taken along a line VI—VI.

In one embodiment of this invention shown in FIGS. 5 and 6, beneath a combustion chamber 1 is disposed coaxially a blast member 2 having a smaller diameter than the combustion chamber 1 and provided with a cylindrical hollow space 3. A gas pipe 4 and an air pipe 5 are tangentially connected to the blast member 2. A plurality of annular gas passages 14 and air passages 15 are formed in the blast member 2. The passages 14 and 15 are alternately stacked in the vertical direction and are connected to gas pipe 4 and air pipe 5, respectively. Gas blow openings 6 and air blow openings 7 equally inclined with respect to the horizontal radii extending from the center of the cylindrical space 3 are formed to communicate the respective annular gas and air passages 14 and 15 with the space 3. An annular air blow opening 13 communicated with the air pipe 5 is provided on the upper periphery of the blast member 2 to form an upward air flow along the inner wall of the combustion chamber 1. The air blow opening 13 has a generally vertical rectangular cross-section (FIG. 6) and opens to the combustion chamber 1 at its upper end. In the embodiment shown in FIGS. 5 and 6 the central space 3 is cylindrical and the gas and air blow openings 6 and 7, respectively, are inclined to the vertical but the inclination angle of the uppermost air blow openings 7 (if desired, also the next lower air blow openings 7) is made to be smaller than that of the lower air blow openings 7. The upper end of the space 3 is connected to the combustion chamber 1 by a generally conical surface 16 at the upper end of the blow member 2. To acquire a desirable vertical flow rate and to positively form a counter flow region described hereinafter, it is advantageous to select the diameter $D_1$ of said cylindrical space 3 to have a ratio of about 0.4 – 0.7 with respect to the diameter $D_2$ of said combustion chamber 1.

Figure 7:
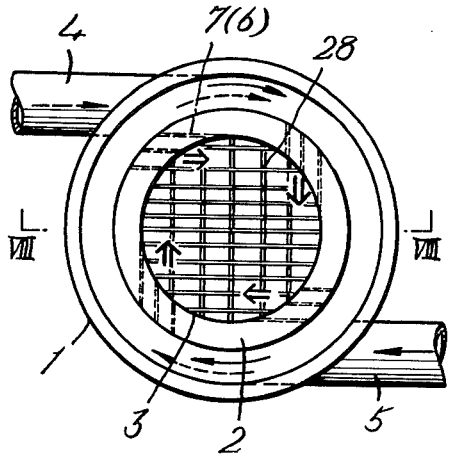
FIG. 7 is a plan view showing a modified embodiment of this invention.
Figure 8:
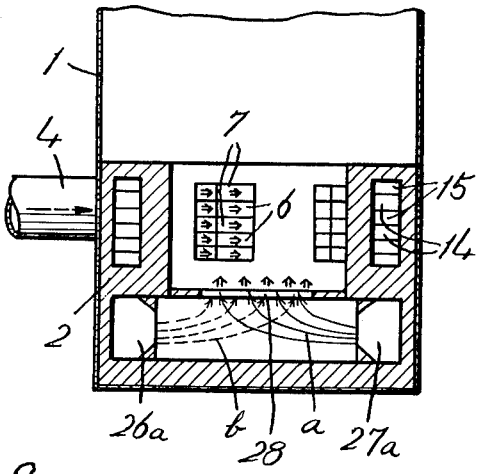
FIG. 8 is a sectional view of the embodiment shown in FIG. 7 taken along a line VIII—VIII.

FIGS. 7 and 8 show a modified embodiment of this invention in which a gas blow head 26*a* and an air blow head 27*a* are positioned at the bottom of the combustion chamber 1 at diametrically opposite points for forming parallel gas streams *b* and parallel air streams *a* in the same manner as the prior art burner shown in FIGS. 3 and 4. Also a ceramic grill 28 is used. A glass blow member 2 similar to that shown in FIGS. 5 and 6 and including a cylindrical space 3 is positioned above the blow heads 26*a* and 27*a* and the grill 28. As before, as seen in FIG. 8, alternate annular gas passages 14 and air passages 15 are formed in the blow member 2. Blow openings 6 and 7, inclining with respect to the horizontal radii and to the vertical, are provided to communicate the annular air and gas passages 14, 15 with the space 3. Since upward streams of the gas and air are formed by the blow heads 26*a* and 27*b* at the bottom, the openings 6 and 7 may not be inclined with respect to the vertical as shown in FIG. 8. Even when openings 6 and 7 are horizontal, upward swirling streams can be formed.

Figure 9:
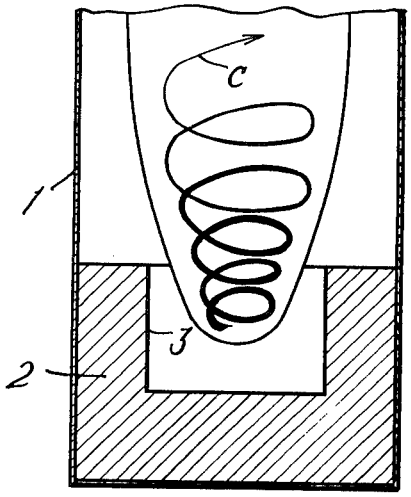
FIG. 9 is a diagrammatic representation useful to explain the manner of forming a upward swirling flow.
Figure 10:
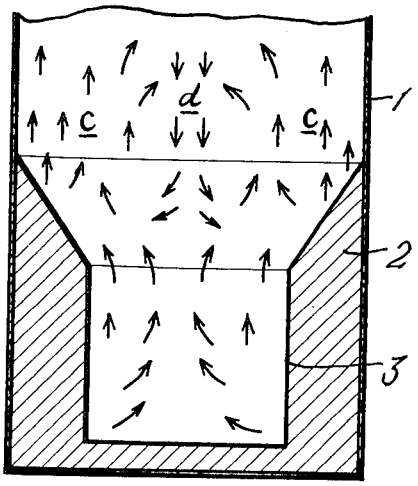
FIG. 10 is a diagrammatic representation to show the upward swirling flow and a counter flow region formed at the center of the swirling flow.
Figure 11:
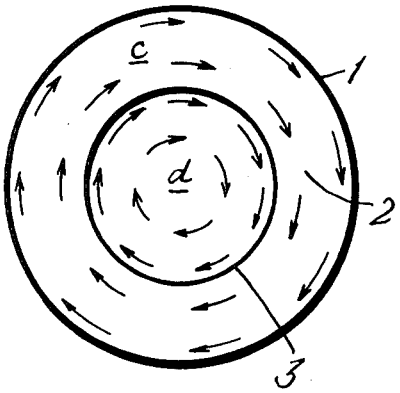
FIG. 11 is a plan view of the diagram shown in FIG. 10.

In the operation of the embodiment shown in FIGS. 5 and 6, wherein the streams of gas and air ejected from annular passages 14 and 15 through blow openings 6 and 7, a flow rate of several to several tens meters per second may be obtained, similarly as the prior art, the flow being inclined with respect to the radii to form an upward swirling flow *c* as shown in FIG. 9. Such swirling flow assures intimate mixing of air and gas in the cylindrical space 3. Furthermore, this swirling upward flow forms a counter flow region d at the central portion of the combustion chamber 1 as shown in FIGS. 10 and 11. Consequently, a flame holding effect is provided for forming a stable flame not affected by the variation in the flow quantities of air and gas and in the air-fuel ratio. Further, as the combustion gas circulates in the counter flow region *d* the stay time of the combustion gas in the combustion chamber is increased substantially, thereby enhancing complete combustion. Accordingly, the length of the flame is decreased so that it is possible to eliminate the defects of oscillatory combustion, formation of too long a flame, and after burning caused by incomplete combustion pointed out hereinabove. Although the length of the flame can be varied by changing the ejection angle of the nozzles, if the vertical inclination angle of the blow openings 6 and 7 were reduced to increase the momentum an extremely short flame along the wall would be formed which is not desirable although the air stream ejected from the vertical opening 13 prevents damage to the wall surface of the combustion chamber. Accordingly, it is advantageous to select the inclination angle $\beta$ of the openings 6 and 7 with respect to the tangents toward the radii to be in a range of 30° to 80° whereas to select the vertical inclination angle $\alpha$ to be in a range of 30° to 90° with respect to the vertical directions.

In the embodiment shown in FIGS. 7 and 8 the gas and air blown into the space 3 through inclined openings 6 and 7 form a upward swirling flow *c* as shown in FIG. 9. Moreover, as the counter flow region is formed at the central portion, the combustion condition of the flame formed by the parallel flows of air and gas supplied by blow heads *26a* and *26b* through the grill 28 is greatly improved and the stay time of the gas mixture in the combustion chamber is also increased, thereby stabilizing the flame. That is to say, in this case, it is advantageous to select the appropriate ratio of the total amount Qr of air and gas injected from the burner to that Qs from the grill so as to acquire desirable burning. As a result of our experiments we have found that the length of the flame can be reduced to about one half of that of the flame produced by the conventional nozzle shown in FIGS. 3 and 4. Moreover, the length of the flame is not affected by the variation in the air-fuel ratio so that stable combustion can be assured. Further, even when a large quantity of gas is burned, no oscillatory combustion is formed.

The degree of swirling S{$S=Pt/(Pt+Pa)$ [Pt: swirling flow power, Pa: linear flow power]}, that is the ratio of the momentum of linear flow of the air-gas mixture produced by the blow heads *26a* and *27a* at the bottom to the momentum of the swirling flow. The length of the flame can be adjusted to any desired length by varying the degree of swirling S, so that it is possible to prevent damage to the wall of the combustion chamber caused by the flow of the flame closely along the surface thereof. Though the value of Pt varies according to the inclination angle of each nozzle, it is effective to select the ratio Qr/Qs of the total amount Qr of air and gas injected from the burner to that Qs from the grill in a range of 0.1 - 10 in order to acquire desirable burning and to prevent the after burning caused by incomplete burning as in the embodiment shown in FIGS. 3 and 4. Generally speaking, it is advantageous to make $S = 0.1 - 0.2$, the vertical inclination angle $\alpha$ from 30°–90° and the inclination angle $\beta$ with respect to the tangents toward the radii from 30°–80°, which is equal to 50 to 70% of that of the conventional burner shown in FIG. 3 and 4.

As has been described hereinabove, the burners of the present invention are capable of eliminating various disadvantages and defects of the prior burners for use with a blast furnace, that is, they can prevent oscillatory combustion, after burning caused by incomplete combustion and damage of the gitter bricks of the accumulating chamber caused by an excessive elongation of the flame which are inherent to high load conbustion utilizing high temperature blast air in a blast furnace having a large capacity. The burner of this invention always assures stable combustion under varying air-fuel ratios and other varying conditions thereby preventing generation of such harmful gasses as NOx, $SO_2$, etc. Moreover, as it is possible to prevent excessive elongation of the flame it is not necessary to increase the height of the combustion chamber. Thus, by using the improved swirling burner of this invention, it is possible to improve the operation and heat efficiency of the modern blast furnaces of large capacities.

While the invention has been shown and described in terms of some preferred embodiments thereof it should be understood that the invention is by no means limited to these embodiments and that many changes and modifications may be made without departing from the true spirit and scope of the invention as defined in the appended claims.

What is claimed is:

1. In a swirling burner for use in a hot blast stove, comprising:

a vertical combustion chamber; and an annular blast member located beneath said combustion chamber substantially in coaxial relationship therewith for forming a swirling flow of a gas and air mixture, said annular blast member including: a central cylindrical space; a plurality of fuel gas passages and a plurality of air passages arranged about said cylindrical space; and a plurality of fuel gas openings and air blow openings respectively connected to said fuel gas and said air passages;

the improvement wherein:

the diameter of said cylindrical space is smaller than that of said combustion chamber;

said plurality of fuel gas and air passages are vertically alternately superposed above one another; and said fuel gas and said air blow openings directly open into said cylindrical space and are inclined in the same horizontal direction with respect to the radii from the axis of said cylindrical space, and are further inclined with respect to the vertical axis of said cylindrical space.

2. The swirling burner according to claim 1, further comprising a gas inlet pipe and an air inlet pipe, said fuel gas passages and air passages being annularly formed in said annular blast member, said fuel gas passages being tangentially connected to said gas pipe and said air passages being tangentially connected to said air pipe.

3. The swirling burner according to claim 1, wherein the diameter of said cylindrical space has a value such that the ratio of the diameter of said cylindrical space to the diameter of said combustion chamber is between 0.4 and 0.7.

4. The swirling burner according to claim 1, further comprising a fuel gas blow head and an air blow head, said blow heads being located below said annular blast member and being opposing each other; and a heat resistant grill located between said annular blast member and said blow heads for creating a generally straight upwardly directed flow of an air-gas mixture.

5. The swirling burner according to claim 1 wherein the uppermost air blow openings have a smaller inclination with respect to the vertical than the lower air blow openings.

6. The swirling burner according to claim 1 wherein said fuel gas openings and said air blow openings are inclined 30° to 80° with respect to the tangents toward the radii of said cylindrical space.

7. The swirling burner according to claim 1 wherein said fuel gas openings and air blow openings are inclined 30° to 90° with respect to the vertical.

8. The swirling burner according to claim 1 wherein said annular blast member is provided with a vertically directed air blow opening for blowing an air stream along a wall surface of said combustion chamber.

* * * * *